United States Patent [19]

Bisbing

[11] Patent Number: 4,763,935

[45] Date of Patent: Aug. 16, 1988

[54] DOOR OR PANEL FASTENER

[75] Inventor: Robert H. Bisbing, Springfield, Pa.

[73] Assignee: Southco, Inc., Concordville, Pa.

[21] Appl. No.: 30,668

[22] Filed: Mar. 25, 1987

[51] Int. Cl.[4] ..... E05C 5/02

[52] U.S. Cl. ..... 292/66; 292/DIG. 60

[58] Field of Search ..... 292/57, 58, 62, 63, 292/64, 66, 71, DIG. 60

[56] References Cited

U.S. PATENT DOCUMENTS

| | | | |
|---|---|---|---|
| 83,112 | 10/1868 | Tobey | 292/57 X |
| 368,595 | 8/1887 | King | 292/57 X |
| 1,193,148 | 8/1916 | Hornung | 292/57 |
| 1,907,625 | 5/1933 | Vogt | 292/62 X |
| 2,829,609 | 4/1958 | Pisani | 292/62 X |
| 2,860,904 | 11/1958 | Barry et al. . | |
| 3,021,165 | 2/1962 | Hamilton et al. | 292/57 X |
| 3,302,964 | 2/1967 | Barry . | |
| 3,397,000 | 8/1968 | Nakanishi | 292/61 |
| 3,402,958 | 9/1968 | Barry . | |

FOREIGN PATENT DOCUMENTS

85/04443 10/1985 World Int. Prop. O. ..... 292/57

*Primary Examiner*—Richard E. Moore

*Attorney, Agent, or Firm*—Paul & Paul

[57] ABSTRACT

A rotary operated latch of the "lift and turn" fastener type is disclosed having a cam action in the handle such that when the handle is moved to a latched position, it provides a pull on the pawl to compress a door or panel against a door or panel frame, or its gasket, to provide a tight seal. An over-center action prevents accidental release. A slot and pin arrangement prevents moving the handle to a latched position, except when the pin and slot are aligned. While the pawl and handle are normally rotatable relative to a sleeve in the door or panel which carries the mechanism, the pin and slot are so located as to be incapable of sufficient axial relative movement to move the handle into a latched position, except when the pawl is rotatably positioned for movement into a latched position.

7 Claims, 1 Drawing Sheet

DOOR OR PANEL FASTENER

BACKGROUND OF THE INVENTION

The present invention relates to door or panel fasteners of the type adapted to be mounted along the edges of doors or panels which overlap a wall or frame. The fastener has a latching pawl which is connected to a handle, such that the pawl is movable inwardly and outwardly in an axial direction, depending upon over-center movement of the handle between latched and unlatched positions. The pawl is mounted on a slide member that is received for axial movement within and relative to a sleeve, which sleeve is mounted on the dooror panel and carried thereby. The pawl is also rotationally movable relative to the sleeve, upon rotational movement of the handle. The present invention is directed to an improvement in such fasteners adapted to prevent actuation of the handle to its latched position in any but the correct rotational position of the handle, which correct position corresponds to the correct rotational position of the pawl, to prevent the handle from having the appearance of having the pawl engaged in a latched position when the pawl is not in fact engaged in a latched position. Additionally, the present invention is directed to preventing rotation of the handle when the pawl is in the latched position, in order to prevent accidental movement of the handle and consequently the pawl carried thereby,from a latched position of the pawl.

DESCRIPTION OF THE PRIOR ART

The present invention is an improvement upon that disclosed in U.S. Pat. Nos. 2,860,904, 3,302,964, and 3,402,958. The complete disclosure of U.S. Pat. No. 3,402,958 is herein incorporated by reference.

SUMMARY OF THE INVENTION

The present invention is directed toward providing an improvement in a fastener between two members, and thus provides a latch assembly comprising a sleeve which projects through an opening in one of two members that are to be secured together, a handle, and a slide member, with the slide member being axially slidable and rotatable relative to the sleeve member upon movement of the handle between latched and unlatched positions and upon rotation of the handle, and with the slide member carrying a pawl for movement therewith, with the improvement allowing movement of the handle to a latched position only when the slide is rotatably positioned such that the pawl carried thereby is in a latching position.

OBJECTS OF THE INVENTION

Accordingly, it is a primary object of this invention to provide a novel latch assembly of the "lift and turn" type that is constructed to prevent actuation of the handle to its locked position in any position but the correct rotational position.

It is another object of the present invention to prevent rotation of the handle of a latch assembly when the handle is in the latched position.

It is a further object to accomplish each of the above objects by the use of a latch assembly having a handle, a sleeve member, and a slide member with a pawl on the end of it, in such a way that movement of the handle to a latched position is permitted only when the slide member is rotatably positioned such that the pawl carried thereby is in a latching position.

It is a further object of this invention to accomplish the above object by aligning a sleeve and a slide member only when the pawl is in a position in which it can be securely latched, and in that position, allowing the handle to be moved to a latched position.

It is a further object of the present invention to accomplish the above objects, by the use of an over-center, spring loaded cam means.

Other objects and advantages of the present invention will be readily apparent to those skilled in the art from a reading of the following brief descriptions of the drawing figures, the detailed description of the preferred embodiments, and the appended claims, as well as the application that is herein incorporated by reference.

BRIEF DESCRIPTIONS OF THE DRAWINGS

DETAILED DESCRIPTION OF THE PREFERRED EMBODIMENT

Because of the detailed recitation of latch assemblies as set forth in U.S. Pat. No. 3,402,958, and because of the incorporation of the entire subject matter of that patent into this application, by reference, this description will focus on the particular improvement offered herein, while omitting substantial portions of the description as are set forth in U.S. Pat. No. 3,402,958, in order to avoid duplication.

Figure 1:
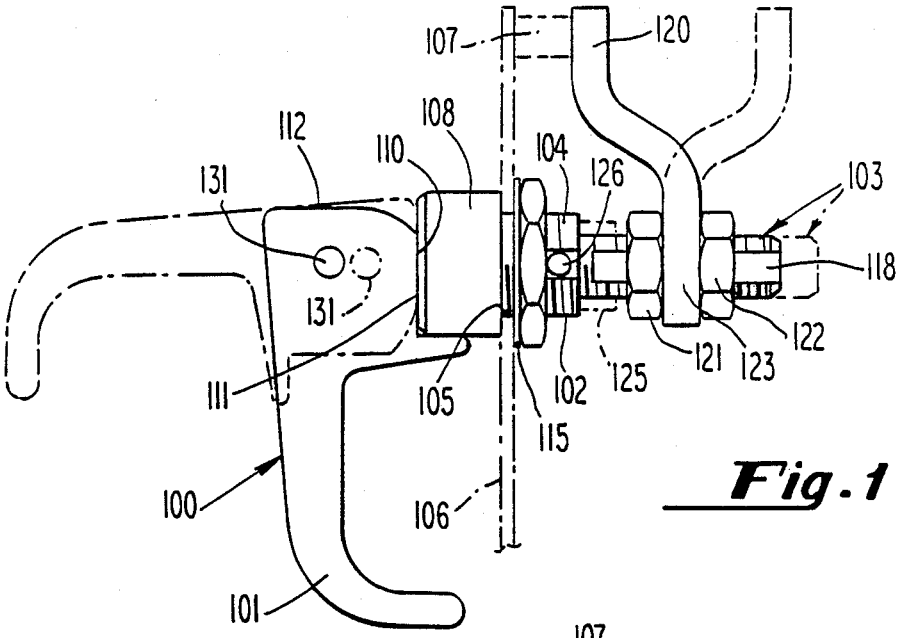
FIG. 1 is a side elevational view of the latch assembly in accordance with this invention, disposed on a door or like panel member illustrated in phantom, with the handle of the latch member being illustrated in both full line and phantom positions representing latched and unlatched positions for the handle and with the pawl being illustrated in two alternative positions.

Referring now to the drawings in detail, reference is first made to the latch assembly of FIG. 1, generally designated by the numeral 100, as comprising a handle 101, a sleeve 102, and a slide member 103. The sleeve 102 has a screw-threaded outer surface 104 and is received in an opening or hole 105, in a door or panel 106 illustrated in phantom, which panel 106 is desired to be retained in engagement against a frame member 107, also illustrated in phantom, with a compressive force between said members 106 and 107. The sleeve 102 is provided with a head 108 of generally rectangular configuration if viewed from the left end of FIG. 1, with the outer surface 111 thereof forming a camming surface, against which there is cammed the several surfaces 112, 113, 114 of the handle 101, as the handle is moved between the positions that are illustrated in FIGS. 1 and 2.

The head 108 of the sleeve 102 is secured against one side of the door panel 106, and locked thereto, by means of a spring washer 115 and a nut 116 secured thereto on the threaded outer surface 104 of the sleeve, such that the sleeve is fixed against rotatable movement relative to the panel or door 106, irrespective of any turning forces that are applied thereto.

Figure 2:
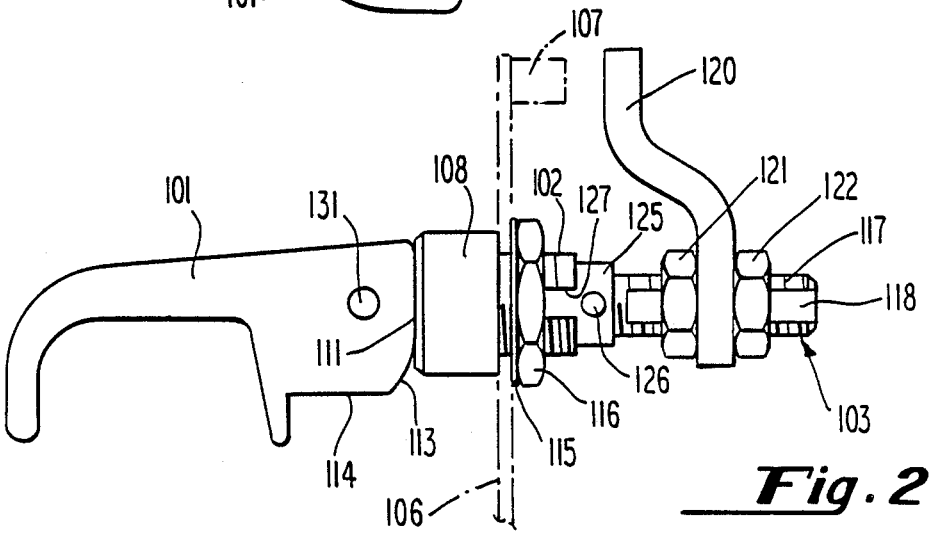
FIG. 2 is a view similar to that of FIG. 1, but wherein the handle is in the unlatched position, with the pawl likewise disposed in an unlatched position, and with the alignment pin disposed out of its associated slot, having been axially moved to this position upon movement of the handle from its full line position of FIG. 1, to the full line position of FIG. 2.

The slide member 103 is provided with a screw-threaded outer surface 117 with flat surfaces 118 on front (shown) and back (not shown) sides thereof, as viewed in FIGS. 1 and 2, for a substantial portion of its length as shown. A pawl 120 is shown, secured between locking nuts 121 and 122 thereon, with the lower end of the pawl having a flat sided opening therein (not shown), for sliding over the right-most end of the slide member 103, such that flats on an opening in the pawl member engaged against the flats 118 of the slide member 103, to prevent rotation of the pawl 120 relative to the slide member 103, when forces are exerted in rotatable directions relative thereto.

It will thus be seen that the pawl 120 is adapted for engagement against the frame or other member 107, as the latch assembly is moved to a latched position as illustrated in FIG. 1, from an unlatched position as illustrated in FIG. 2.

In FIG. 1, there is illustrated in phantom, an alternative mounting arrangement for the pawl 120, if the outer end of the pawl is desired to engage against a member (not shown), that is more remote rightward from the frame member 106, than that 107 illustrated in FIG. 1. It will also be understood that the pawl 120 may originally be mounted in any of a plurality of positions of rotation on the slide member 103, as is permitted by the shape of the opening in the pawl that mounts on the flat-sided threaded right end of the slide member 103.

Figure 3:
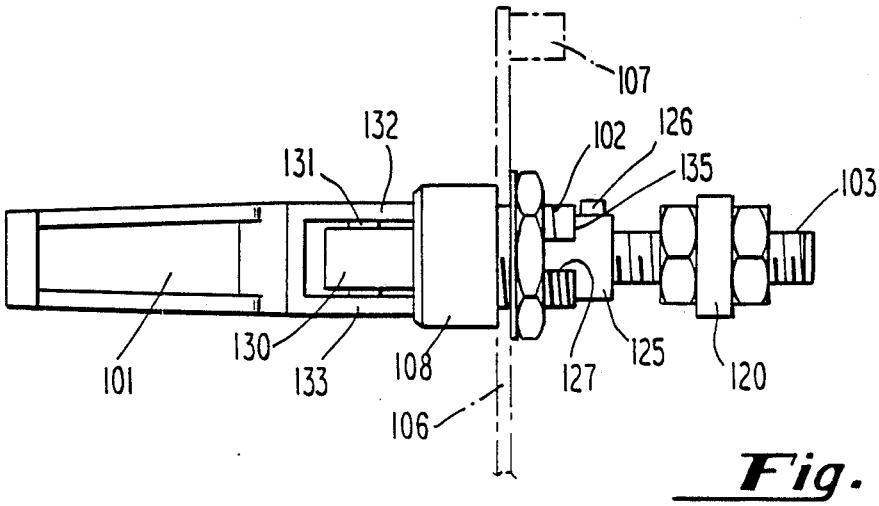
FIG. 3 is an illustration similar to that of FIG. 3, but with the handle, slide member, and pawl having been rotated 90 degrees relative to the sleeve.

The slide member 103 is provided with a bearing bushing member 125 mounted for movement therewith, such that the outer periphery of the bushing member 125 slides within the inner-surface of the sleeve 102 as the handle is moved between latched and unlatched positions, but with the bushing member 125 being fixedly carried by the screw portion or threaded portion 117 of the slide member 103, by means of a pin 126 interconnecting the same, in the manner of a dowel pin, with the pin 126 being sized to extend outwardly of the outer surface of the bushing 125, as illustrated in FIG. 3.

The sleeve 104 is provided with a longitudinally directed slot 127 (although the same could be a groove, or other functional equivalent, if desired), for accommodating the pin 126 therein, upon movement of the handle 101 to the position illustrated in FIG. 1, from the unlatched position therefor illustrated in FIG. 2.

The left-most end of the slide member 103 extends through the head 108 of the sleeve 102, to have a pivot connector portion 130 in pivotal engagement on a pivot pin 131 extending therethrough, and carried between opposite legs 132 and 133 that form opposite sides of the handle 101. A compression spring (not shown) is disposed inside the sleeve 102, to generally urge the slide member 103 rightward as viewed in FIGS. 1, 2, and 3, and the same exerts a force against moving the handle 101 between the two over-center positions of FIGS. 1 and 2, in that it opposes a camming force that must be applied in moving the handle 101 between the full line and phantom positions illustrated in FIG. 1.

It will thus be seen that, with the handle 101 in an unlatched position as illustrated in FIG. 2, the pawl is not in engagement against frame member 107, and the alignment pin 126 is disposed for receipt within slot 127 of sleeve 102, when the handle is in a proper rotatable position for the pawl 120 to engage the member 107. With the handle 101 and the pawl 120 thus properly positioned, as illustrated in FIG. 2, for locking or latching engagement of the assembly, movement of the handle 101 downwardly from the phantom position illustrated in FIG. 1, or the full line position illustrated in FIG. 2, to the full line position illustrated in FIG. 1, will cause the camming surface 113, acting in engagement against the cam surface of the head 108, to pull the slide member 103 leftwardly from the position illustrated in full lines in FIG. 2 or in phantom in FIG. 1, to the full line position therefor illustrated in FIG. 1, with the latching mechanism moving to an over-center position in which the camming surface 114 will be in flat engagement against the surface 111 of the head 108. This will effectively draw the slide member 103 leftwardly as viewed in FIG. 1, such that the pin 126 is received within the slot 127, an amount sufficient that the pawl 120 will enter into compressive engagement against the frame member 107, under the desired, preset force as has been pre-planned upon setting of the screws 121 and 122 on the threaded surface 117, is applied on the pawl.

Upon unlatching of the assembly, by lifting the handle 101 upwardly once again, to reach the position in full lines in FIG. 2, the pawl is released. Unlatching may then be completed by rotating the handle 101 some amount, such as 90 degrees (more or less, as desired) to the position of the handle 101 illustrated in FIG. 3, in which the pawl is likewise turned 90 degrees, so as to be substantially hidden from view as illustrated in FIG. 3. Such rotation of the handle, with the pawl therein, also rotates the bearing bushing member 125 fixedly carried by the slide member 123, and the pin 126 locked thereto and projecting therefrom as illustrated in FIG. 3, such that the pin 126 is no longer in alignment or registry beyond the end of the slot 127. Attempts at this point to turn the handle 101 to an over-center latched position such that its surfaces 114 will be in engagement against the surface 111 of the sleeve head 108 will cause the pin 126 to abut against the outer end 135 of the sleeve 102, and prevent the assembly from being in a latched position.

The operator will therefore know that the pawl 120 is not in a latched position, and that the handle 101 must be moved rotatably so that the pin 126 can engaged within the slot 127, at which point the pawl 120 will be in a proper position for being latched, and then the handle 101 may be moved over-center.

It will thus be seen that the present invention accomplishes the objects of preventing actuation of the handle to its locked position in any but the correct rotational position, and to prevent rotation of the handle when it is in the locked position, the latter being provided by the presence of the pin 126 in the slot 127, when the handle is in its full line position illustrated in FIG. 1, such that attempts to move the handle 101 in a rotatable direction (as distinguished from a direction leading towards axial movement of the slide member 103) will cause the pin 126 to abut against the sides of the slot 127.

It will be apparent that various modifications may be made in the details of construction and use and operation of the present invention. For example, the spring that comprises the compressive loading opposing over-center movement of the handle may be located inside the sleeve 102, or outside the sleeve. Furthermore, the components may take on various configurations and sizes, such as will accomplish the desired ends for any particular job. Also, the bearing bushing, rather than being constructed as a separate member pin-connected to the threaded slide member could be constructed integrally therewith. Furthermore, the slide member 103 is shown having a screw-threaded right end for fastening the pawl 120 thereto, in the preferred illustrations, but such attachment of the pawl to the slide member could be by any means conventional within the art.

Other modifications may likewise be made, and changes made in the details of construction and use and operation of the parts and assembly, all within the spirit and scope of the invention as defined in the appended claims.

I claim:

1. In a latch assembly adapted for developing a compressive force between two members, wherein the latch assembly comprises a sleeve adapted to project through an opening in one of the members, and to be secured non-rotatably therein; with said sleeve being provided with a head and fastening means adapted to engage the one member therebetween when the sleeve is in the opening; with a slide member in said sleeve, movable axially and rotatably therein, with one end of the said member in engagement with a handle and the other end in engagement with a pawl; with said handle, sleeve, and slide member being operatively connected for facilitating movement of said slide member axially between latched and unlatched positions as said handle is moved between latched and unlatched positions; with the pawl being adapted to engage the other member under compressive force when the handle is in the latched position; with said slide member being rotatably movable within said sleeve with rotatable movement of said handle in the unlatched position of said handle, for rotatable movement of said pawl through unlatched positions with said handle; and with said slide member and said handle being rotatably non-movable in the latched position of said handle; the improvement comprising means permitting movement of said handle to a latched position placing the pawl under compressive force only when the slide member is rotatably positioned such that the pawl carried thereby is in a latched position.

2. The latch assembly of claim 1, wherein said latter means comprises alignment means on said sleeve and said slide member for rotatably limiting the relative rotational positions thereof in which the slide member will move axially relative to the sleeve, into a latched position of the handle.

3. The latch assembly of claim 2, wherein said alignment means comprises a pin projecting laterally from said slide member and a slot in said sleeve for receiving said pin therein only in a latched position of said handle.

4. The latch assembly of claim 3, wherein said slide member includes an outer bearing bushing for sliding within said sleeve and an innerscrew member connected to said bushing by said pin, for axial and rotatable movement of said bushing and pin together.

5. The latch assembly of any of claims 1 through 4, wherein the operative connection between said handle and sleeve includes an over-center cam means on said handle for moving the slide member axially upon moving the handle between latched and unlatched positions.

6. The latch assembly of claim 5, including spring means opposing the movement of the handle from one over-center position to another over-center position.

7. The latch assembly of claim 4, wherein said pawl is adjustably positionable on said slide member, both axially and rotatably.

* * * * *